US008371045B2

(12) United States Patent
Tambay

(10) Patent No.: US 8,371,045 B2
(45) Date of Patent: Feb. 12, 2013

(54) HIKING BOOT ATTACHMENT FOR DESCENDING SLOPES

(76) Inventor: Georges-André Tambay, Cochrane (CA)

( * ) Notice: Subject to any disclaimer, the term of this patent is extended or adjusted under 35 U.S.C. 154(b) by 381 days.

(21) Appl. No.: 12/578,460

(22) Filed: Oct. 13, 2009

(65) Prior Publication Data

US 2011/0083344 A1 Apr. 14, 2011

(51) Int. Cl.
*A43C 15/06* (2006.01)

(52) U.S. Cl. ..... 36/62; 36/132; 36/81; 36/7.7; 36/113

(58) Field of Classification Search ..... 36/113, 36/132, 81, 7.7, 62, 116; 482/75–77
See application file for complete search history.

(56) References Cited

U.S. PATENT DOCUMENTS

| | | | | |
|---|---|---|---|---|
| 198,492 | A * | 12/1877 | Lewis | 36/62 |
| 754,577 | A | 3/1904 | Laub | |
| 1,275,917 | A * | 8/1918 | Herman | 36/62 |
| 1,277,135 | A * | 8/1918 | Schemel | 36/62 |
| 1,570,791 | A * | 1/1926 | Solarz | 36/62 |
| 1,998,921 | A * | 4/1935 | Brown | 36/7.7 |
| 2,107,617 | A * | 2/1938 | Oetterer | 36/62 |
| 2,586,749 | A * | 2/1952 | Von Essen | 36/62 |
| 2,693,040 | A * | 11/1954 | Von Essen | 36/62 |
| 3,076,273 | A * | 2/1963 | Wyllie | 36/7.7 |
| 4,005,533 | A | 2/1977 | Anderson et al. | |
| 4,221,029 | A | 9/1980 | Jerome | |
| 5,075,984 | A | 12/1991 | Shiew | |
| 5,339,542 | A | 8/1994 | Kim | |
| 5,752,330 | A | 5/1998 | Snabb | |
| D429,513 | S | 8/2000 | Warner | |
| 6,112,436 | A | 9/2000 | Quellais | |
| 6,360,455 | B1 | 3/2002 | Seo | |
| 6,453,581 | B1 | 9/2002 | Kiniry et al. | |
| 6,698,050 | B1 | 3/2004 | Frye | |
| 7,165,343 | B2 * | 1/2007 | Fukui | 36/81 |
| 7,555,850 | B2 * | 7/2009 | Park | 36/62 |
| 7,766,346 | B2 * | 8/2010 | Spanier et al. | 280/11.12 |
| 2003/0145489 | A1 | 8/2003 | Major | |
| 2007/0163148 | A1 | 7/2007 | Laporte | |
| 2007/0283596 | A1 * | 12/2007 | Park | 36/62 |
| 2008/0189987 | A1 | 8/2008 | Geisser et al. | |

FOREIGN PATENT DOCUMENTS

| | | |
|---|---|---|
| CH | 91145 | 10/1921 |

OTHER PUBLICATIONS

"Camp Quattro Four Point Instep Crampons," Product No. 5002-703, mec.ca, 2008, pp. 1.
"English Translation of Swiss Patent No. 91145," Patent Publication Date: Oct. 17, 1921, pp. 1-3.

* cited by examiner

*Primary Examiner* — Ted Kavanaugh
(74) *Attorney, Agent, or Firm* — Cesari and McKenna, LLP

(57) ABSTRACT

In one embodiment, a hiking boot attachment is provided that assists in the descent of slopes. The hiking boot attachment includes a platform that engages the underside of a mid-portion of a sole of a hiking boot, in a region under a ball of a hiker's foot. A strap system is attached to the platform and secures the platform to the hiking boot. Further, one or more supports are secured to the platform. The one or more supports each have a portion that extends downward from a bottom face of the platform to engage the ground and lift the platform above the ground. This may reduce incline of the hiking boot when descending a slope. The portions of the one or more supports that engage the ground deliver downward force to regions of ground disposed to lateral sides of the hiking boot, to promote stability.

13 Claims, 7 Drawing Sheets

HIKING BOOT ATTACHMENT FOR DESCENDING SLOPES

BACKGROUND

1. Technical Field

The present disclosure relates generally to hiking equipment and more specifically to an attachment securable to a hiking boot that assists in the descent of slopes.

2. Background Information

Hikers face many challenges when traversing backcountry terrain. One of these challenges is ascending and descending slopes, for example, hills or mountains. When a hiker ascends a slope, the primary challenge is to their cardiovascular system, as significant physical exertion is required to lift the hiker's body weight, as well as the weight of any gear and/or provisions the hiker is carrying. While this is a significant challenge, it can be mitigated through conditioning. For example, a hiker of nearly any age may significantly improve their cardiovascular conditioning through a regimen of aerobic exercise, and by making certain lifestyle choices. In this manner, a dedicated hiker may reduce the primary challenge faced when ascending slopes.

When a hiker descends a slope, the primary challenge is not to their cardiovascular system, but rather to their muscular and skeletal system, particularly to the muscles and bones of the knee. During a descent, significant strain is placed upon the knee, as the knee is used by the hiker nearly continuously to "brake", i.e., restrain, their forward momentum. Generally, this "braking" places a large amount of tension upon the knee extensor, which generates increased pressure on the knee cap and cartilage of the knee joint. Over many hikes, this may cause damage to the knee.

Unlike the challenges to the cardiovascular system faced when ascending slopes, the challenges to the muscular and skeletal system faced when descending slopes generally cannot be effectively mitigated through conditioning. The forces involved typically challenge even the well-conditioned knee of a young hiker.

Various devices have been used and/or proposed to be used to attempt to mitigate the challenges faced when descending slopes. However, such devices have generally suffered notable shortcomings, rendering them inconvenient, ineffective, or simply impracticable.

For example, a variety of types of trekking poles and hiking sticks have been used by hikers. With trekking poles or a hiking stick, a hiker may transfer a portion of force from their lower body to their upper body, engaging otherwise underutilized muscles of their arms and shoulders to assist in the hike. While descending a slope, a hiker may use their poles or stick to attempt to "brace" themselves, to restrain at least a portion of their forward momentum, or otherwise reduce strain on their knees. While this may provide a certain degree of relief, only a portion of the strain may be effectively removed from the knees with poles or a hiking stick, and the remaining strain may still be problemsome.

In addition to trekking poles and hiking sticks, several different types of lift devices employing a lifting block or lifting wedge have been proposed to attempt to mitigate the challenges faced when descending slopes. Such lift devices typically secure under the frontal portion of the sole of each hiking boot, with their lifting block or lifting wedge raising the frontal portion of the sole above the ground. When in use, these lift devices attempt to maintain the hiker's boots at an incline less than the incline of the slope, e.g., substantially flat. While this may offer some relief, previously proposed lift devices employing a lifting block or lifting wedge have typically suffered from a number of shortcomings, limiting their effectiveness and viability.

Lift devices that employing a lifting wedge, typically suffer from durability issues, as the thinnest regions of the wedge typically wear our easily. They also typically present comfort issues, as they generally extend under the toe-region of a hiking boot, and the extra thickness they provide in this region may impede the typical heal-to-toe rocking motion of a normal stride, effecting ones gait and posture. Further, they may present stability issues. Lift devices that employ a lifting wedge typically extend less than, or up to, the width of the hiking boot. Given the extra height they provide, their limited width may compromise the lateral stability of the hiking boot. Finally, lift devices that employ a lifting wedge typically lack any type of height adjustability (e.g., the lifting wedge typically has a fixed angle and height), and thus may be poorly suited for slopes of some grades, or hikers with certain sized feet.

Similarly, lift devices that employ a lifting block also typically suffer shortcomings. As with lift devices that employ a lifting wedge, devices that employ a lifting block typically extend under the toe-region of the hiking boot, and may impede the typical heal-to-toe rocking motion of a normal stride. Similarly, lift devices that employ a lifting block typically extend less than, or up to, the width of the hiking boot and, as such, may compromise the lateral stability of the hiking boot. Finally, lift devices that employ a lifting block typically lack any type of height adjustability (e.g., the lifting block typically has a fixed thickness) and thus may be poorly suited for slopes of some grades, or hikers with certain sized feet.

Accordingly, there is a need for a device and a method of use for assisting a hiker in descending slopes that addresses some, or all, of the above discussed shortcomings.

SUMMARY

A novel hiking boot attachment is provided that assists in the descent of slopes. The hiking boot attachment operates to raise a mid-portion of a hiking boot (centered under the ball of the hiker's foot), to cause the incline of the hiking boot to be less than the incline of the slope being traversed, thereby reducing strain on the hiker's knee. The hiker may experience the descent of the slope as similar to walking down stairs, for example, with their feet remaining substantially horizontal with each step. In some configurations, the hiking boot attachment may leave the toe of the boot substantially free to rotate, so as to not impede the heal-to-toe rocking motion of a normal stride. Further, the hiking boot attachment may deliver the hiker's weight to regions of ground disposed to lateral sides of the hiking boot, that are located wider apart than the width of the hiking boot, to increase lateral stability. Still further, the hiking boot attachment may be height adjustable, to permit the hiker to readily customize the attachment to suit the grade of the slope encountered and/or the size of their feet.

In one embodiment, the hiking boot attachment includes a platform configured to engage the underside of a mid-portion of a sole of a hiking boot, in a region under the ball of a hiker's foot. The platform may have a bottom face directed towards the ground, and a top face directed towards the sole of the hiking boot. A strap system may be configured to secure the platform to the hiking boot. Further, one or more supports may be secured to the platform. In some configurations the supports may be detachable supports that are removably secured to the platform. The one or more supports may each have a portion that is configured to extend downward from the bottom face of the platform to engage the ground and lift the platform, and in turn the mid-portion of the sole of the hiking boot under the ball of the hiker's foot, above the ground. Thereby the hiking boot attachment may reduce the incline of the hiking boot with respect to the ground when descending a slope. The one or more supports that engage the ground may be configured to collectively deliver downward force to regions of ground disposed to lateral sides of the hiking boot that are located wider apart than a width of the hiking boot, to promote lateral stability

BRIEF DESCRIPTION OF THE DRAWINGS

The description below refers to the accompanying drawings of an example embodiment, of which.

DETAILED DESCRIPTION

Figure 1:
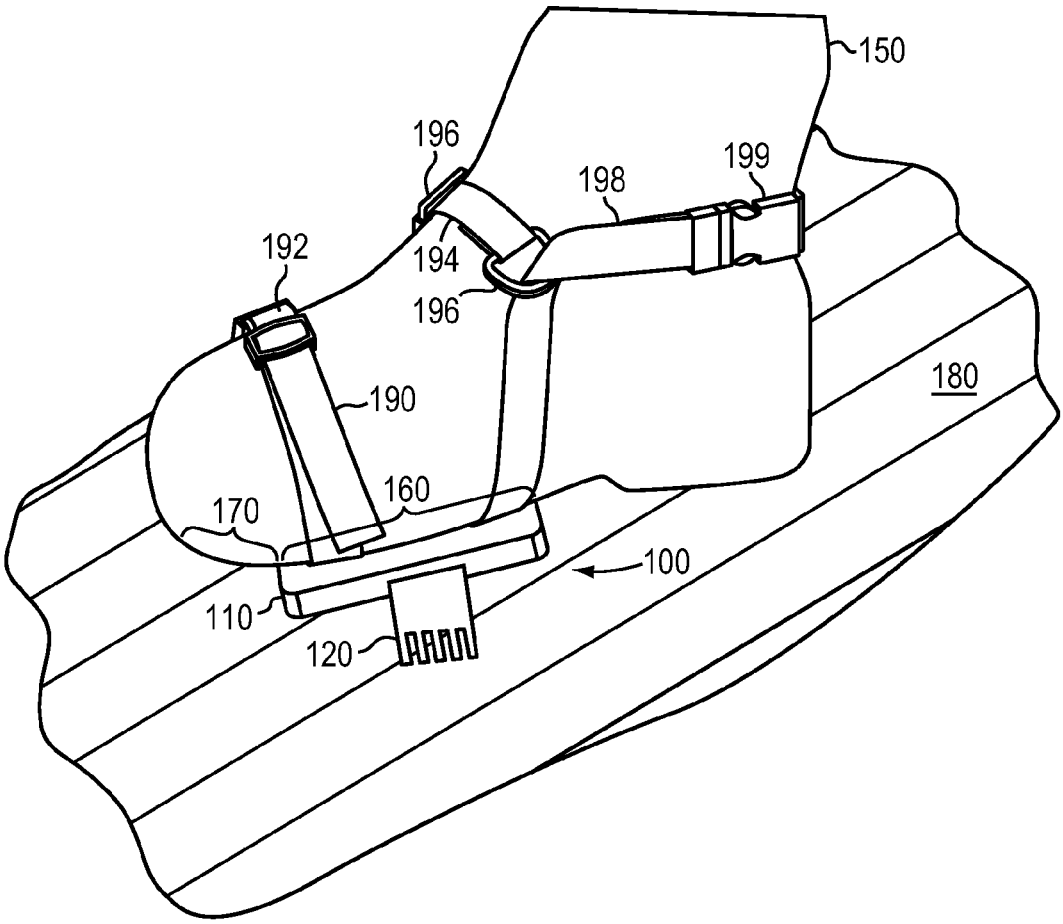
FIG. 1 is a first perspective view of an example hiking boot attachment secured to a hiking boot.

Referring to FIG. 1, an example hiking boot attachment 100 may be secured to a hiking boot 150. The hiking boot attachment 100 includes three primary components: a platform 110, first and second detachable supports 120 (of which only the first detachable support visible in FIG. 1), and a strap system that includes straps 190, 194, 198, When secured to a hiking boot 150, the attachment 100 operates to raise a mid-portion 160 of the sole of the hiking boot 150 (centered under the ball of the hiker's foot) off the ground 180, to decrease the incline of the boot when descending sloped ground. For example, the hiking boot 150, and thus the foot of the hiker, may remain substantially horizontal, despite the slope of the ground 180, such that the hiker may experience the descent as similar to walking down stairs. Decreasing the incline of the hiking boot 150, and thus the incline of the foot of the hiker, generally reduces strain upon the hiker's knee, as there is less need for the knee to "brake", i.e., restrain, the hiker's forward momentum.

Figure 2:
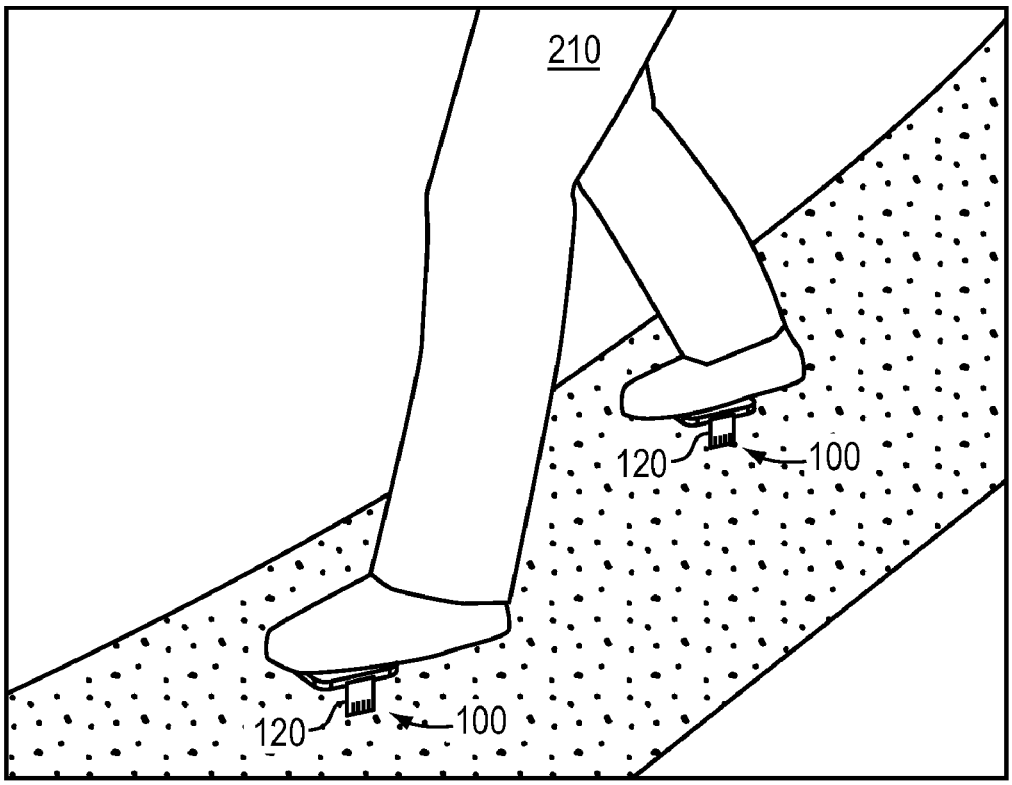
FIG. 2 is a schematic diagram showing a hiker descending a slope with an example hiking boot attachment secured to each hiking boot.
Figure 3:
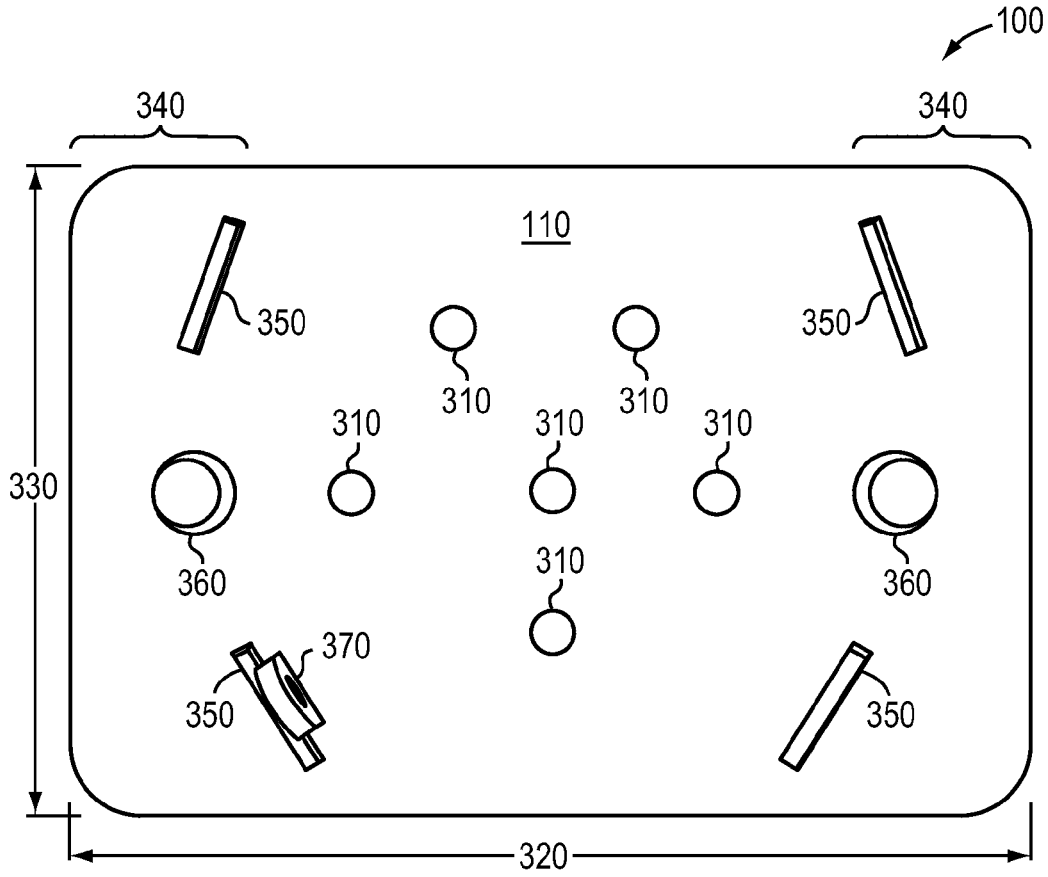
FIG. 3 is a top plan view of the example hiking boot attachment with the strap system removed.
Figure 4:
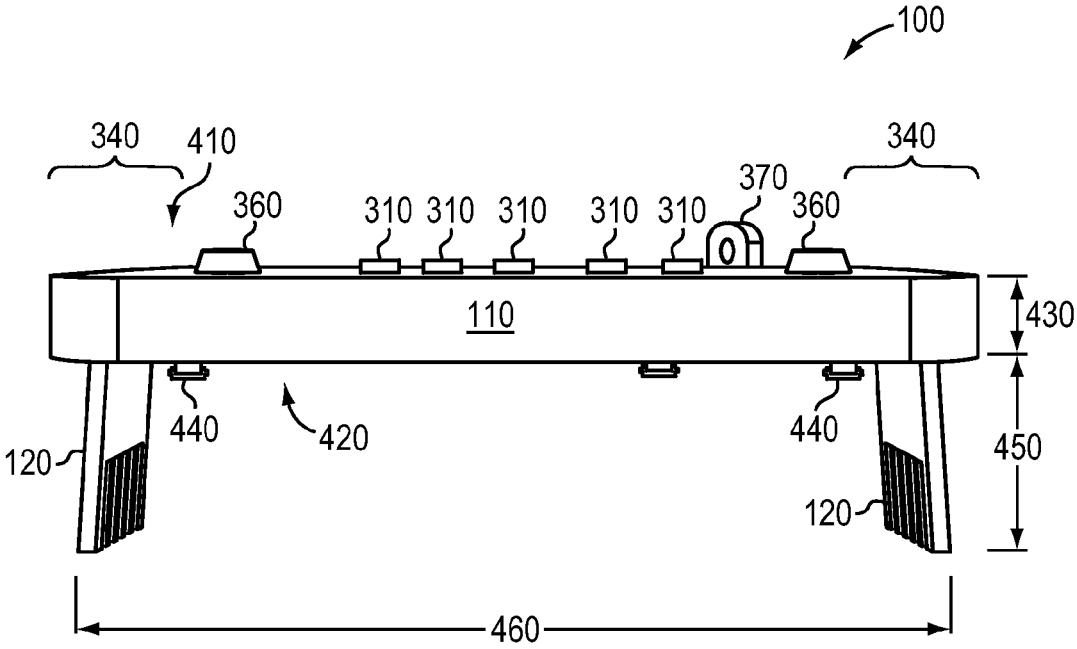
FIG. 4 is a side elevation of the example hiking boot attachment with the strap system removed.
Figure 5:
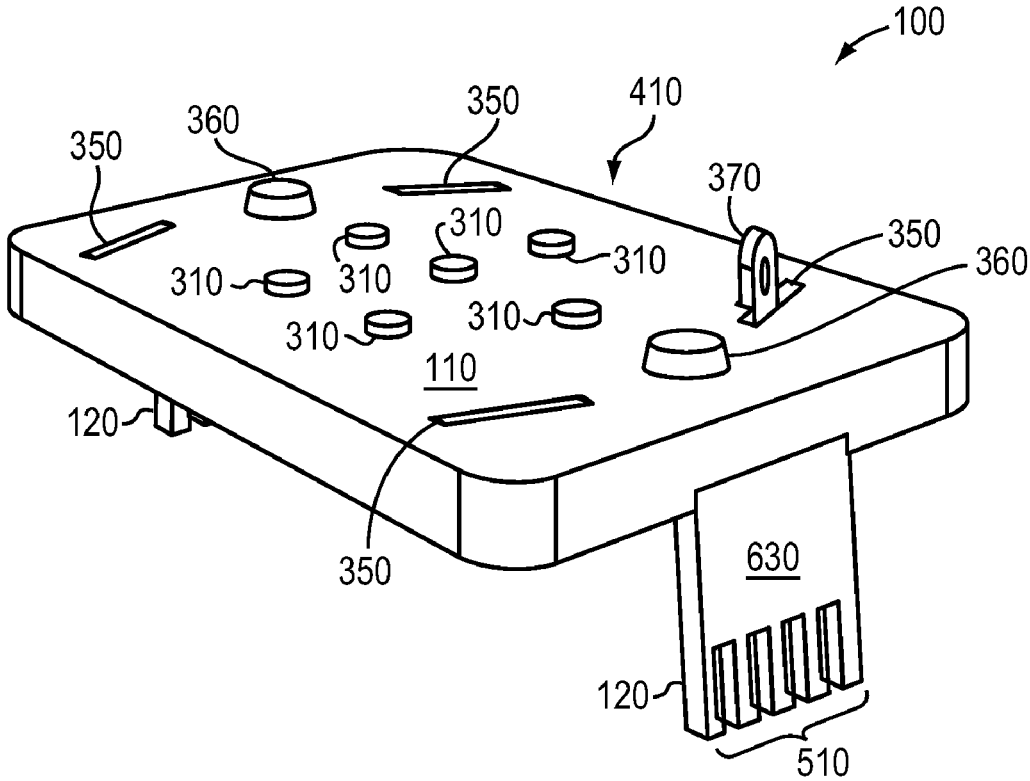
FIG. 5 is an isometric top view of the example hiking boot attachment with the strap system removed.

The hiking boot attachment 100 may leave a toe-portion 170 of the hiking boot 150 substantially free to rotate, so as to not impede the typical heal-to-toe rocking motion of a normal stride. Referring to FIG. 2, when taking a stride, if comfortable given the slope of the terrain, the hiker 210 may pivot their foot about the detachable supports 120. In this manner, the hiking boot attachment 100 may not inhibit the mechanics of a conventional walking motion. Further, as discussed in more detail below, the hiking boot attachment 100 may deliver downward force from the hiking boot 150 to regions of ground disposed laterally wider than the width of the hiking boot 150, to provide increased lateral stability. The hiking boot attachment 100 may also incorporate certain height adjustability features.

Referring to FIGS. 3-6, further details of the platform 110 and detachable supports 120 of the example hiking boot attachment 100 may be seen. The platform 110 may be a substantially rectangular-shaped block of rigid, lightweight material, for example, a block of durable plastic, such as an Ultra-High Molecular Weight (UHMW) polyethylene. However, it should be understood that the platform 110 may be constructed of a different material, or combinations of materials, and be differently shaped, depending on the particular implementation. When in use, a top face 410 of the platform 110 engages the underside of the mid-portion 160 of the sole of the hiking boot 150, in a region centered under the ball of the hiker's foot. A bottom face 420 is directed downward towards the ground 180. In order to securely engage the sole, the top face 410 of the platform 110 may include nubs 310 that interact with treads on the sole of a hiking boot 150. Alternatively, the top face 410 of the platform 110 may instead employ ridges or other protrusions (not shown) to interact with the treads. In still another Alternative, the top face 410 of the platform 110 may instead, or in addition, be treated with a slip-resistant coating or application that may promote grip with the sole of a hiking boot 150.

The platform 110 may be sized to have a width 320 greater than that of the mid-portion 160 of the sole of a typical hiking boot 150, such that, first and second side portions 340 of the platform 110 extend beyond respective sides of the mid-portion 160 of the sole of the hiking boot 150. In one configuration, the width 320 of the platform 110 is approximately 6 inches, the depth 330 of the platform 110 is approximately 4 inches and the height 430 of the platform 110 is approximately ⅜ of an inch. However, it should be understood that in other implementations the platform 110 may be differently sized. The side portions 340 of the platform 110 may be configured to receive straps of the strap system. For example, a plurality of slots 350, here 4 slots, may be disposed in the side portions 340 of the platform 110. Such slots may extend through the platform 110, from its top face 410 to its bottom face 420. As discussed in more detail below, these slots 350 may be used to secure the strap system to the platform 110. Alternatively, rather than slots, the platform 110 may include other features adapted to receive straps of the strap system, for example, integrated loops, or fasteners.

In some configurations, a selected one of the slots 350, in addition to receiving a strap, may house a drift stop 370 that extends up from the top face 410 of the platform. The drift stop 370 may contact the side of the sole of the hiking boot 150 to inhibit unwanted movement of the platform 110 with respect to boot 150. In one configuration, the drift stop 370 is an angular extrusion of a rigid, durable material, such as steel. A vertical leg of the angular drift stop may extend up through the selected one of the slots 350, protruding beyond the top face 410, while a horizontal leg may extend across the bottom face 420 of the platform 110, and be secured thereto with one or more fasteners, for example, screws.

Figure 6:
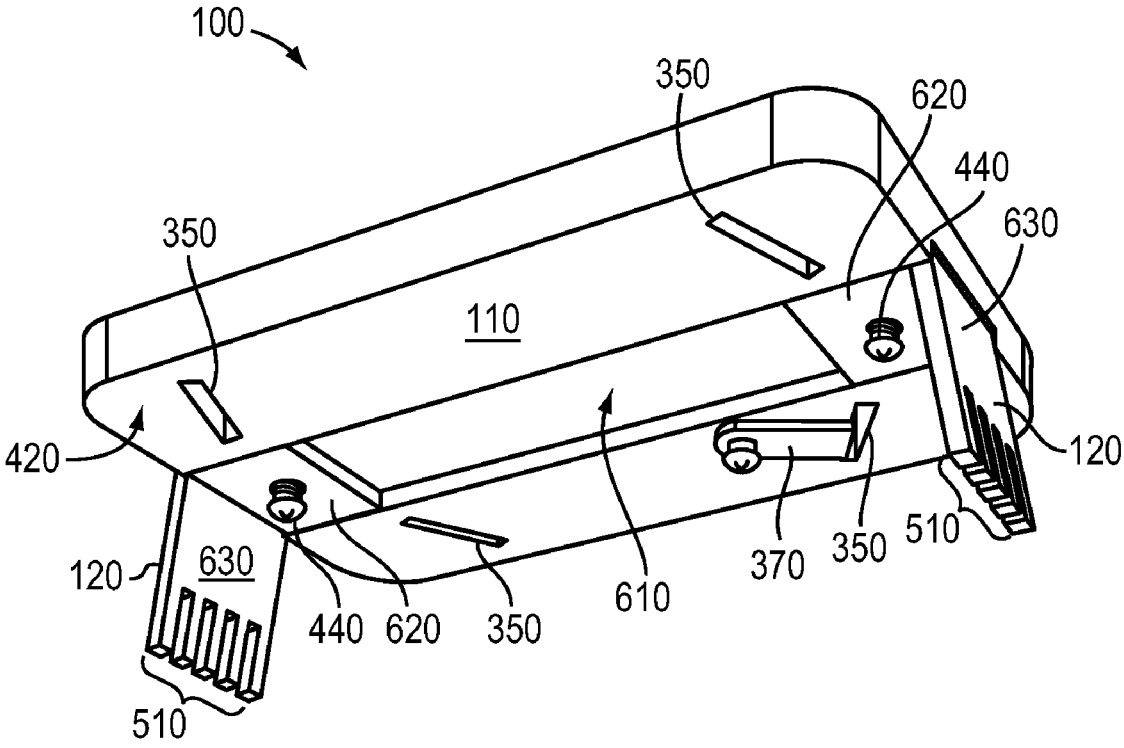
FIG. 6 is an isometric bottom view of the example hiking boot attachment with the strap system removed.

The side portions 340 of the platform may be configured to receive the first and second detachable supports 120, respectively. As shown in FIG. 6, the detachable supports 120 may be partially received (e.g. recessed) in a groove 610 formed in the bottom face 420 of the platform 110. Such groove 610 may substantially prevent rotation of the detachable supports 120. Alternatively, depressions or other indents may be formed in the bottom face 420 of the platform 110 to receive the detachable supports 120. In addition to the mechanical connection provided by the groove 610, the detachable supports 120 may be further secured to the platform 110 using one or more detachable fasteners. For example, each detachable supports 120 may be secured by a screw 440 that extends into the platform 110. A raised and/or strengthened region 360 may be formed into the platform 110 to accommodate each screw 440. Alternatively, the detachable supports 120 may each be secured by a bolt, for example, a carriage bolt that extends from the top face 410 of the platform 110 to bottom face 420, and is capped with a removable nut, for example, a wing nut. In still another alternative, a threaded stud may be secured into the platform 110 and used in conjunction with a removable nut to secure each detachable support 120. In still another alternative, a threaded stud may be secured to, or integrated into, each detachable support 120 and threaded into a threaded socket disposed in the platform 110, or secured by a nut to the platform 110. Accordingly, it should be understood that a wide variety of different types of fastening techniques may be employed to removably secure each detachable support 120 to the platform 110.

The first and second detachable supports 120 may be angular extrusions of a rigid, durable material, for example steel, stainless steel, or another metal. In one configuration, the detachable supports 120 each have a horizontally-extending leg 620, configured to be received in the groove 610 (or other features) formed in the bottom face 410 of the platform 110, and a downwardly-extending leg 630, configured to engage the ground and lift the platform 110, and in turn the sole of the hiking boot under ball of the hiker's foot, above the ground 180. The downwardly extending legs 630 may engage the ground 180, while not penetrating significantly into it. That is, the surface area of the ground-contacting ends of the downwardly-extending legs 630 may be sufficiently large that the supports 120 will not pass more than a few tenths of an inch into most types of ground 180, under the weight of an average hiker. Notches 510 or other types of grip-promoting features may be disposed at the ground-contacting ends of the downwardly-extending legs 630 to prevent slippage on rough terrain.

The downwardly-extending legs 630 may extend downward from the platform 110 substantially vertically (i.e., the angle between the legs of the detachable supports 120 and the platform 110 may be substantially 90°, such that the downwardly-extending legs 630 are perpendicular to the bottom face 420 of the platform 110). Alternatively, the downwardly-extending legs 630 may extend downward and laterally outward from the edge of the platform 110 (i.e., the angle between the legs of the detachable supports 120 and the platform is greater than 90°). This may effectively increase the width 460 between the ground-contacting ends of the downwardly-extending legs 630, to be even greater than the width 320 of the platform 110, which is already greater than the width of the mid-portion 160 of the sole of the hiking boot 150.

By maintaining the width 460 between the ground-contacting ends of the downwardly-extending legs 630 greater than the width of the mid-portion 160 of the sole of the hiking boot 150, the hiking boot may attachment distribute the portion of the hiker's weight incident on the front half of foot to regions of ground 180 beyond the footprint of the hiking boot 150. Specifically, the portion of the hiker's weight incident on the front-half of the foot is delivered substantially equally to two regions of ground 180 disposed respectively to lateral sides of the hiking boot 150, that are wider apart than the width of the mid-portion 160 the hiking boot 150. The portion of the hiker's weight incident on the back-half of foot is primarily delivered to the ground 180 by the heal of the hiking boot 150. Thus, the hiker's weight is effectively distributed to three widely dispersed regions of ground 180, in a tripod-like manner. Such distribution of weight may offer increased lateral stability, especially when traversing rough terrain.

The height 450 provided by the detachable supports 120 (in conjunction with the thinness 430 of the platform 110) determines the rise provided by the hiking boot attachment 100. To permit adjustment of the hiking boot attachment 100 prior to, or during, a hike, detachable supports 120 of various heights 450 (e.g., having downwardly-extending legs 630 of different lengths) may be provided with the hiking boot attachment 100, for example, sold with the attachment 100 or as an optional add-on. A hiker may desire to affix detachable supports 120 that provide a higher rise before descending very steep slopes, to better compensate for the incline of the terrain, while a hiker may similarly desire to affix detachable supports 120 that provide less rise when traversing moderate slopes. Similarly, a hiker with quite large feet may desire to affix detachable supports 120 that provide a higher rise than a hiker with smaller feet, as an increase in the length of the foot typically decreases the amount of incline mitigation a detachable support 120 with a particular rise will provide. In one configuration, detachable supports 120 that provide rise of 1¼ inches and 1½ inches (in addition to the thickness 430 of the platform 110) are provided with the hiking boot attachment 100. However, detachable supports 120 of various other heights are expressly contemplated. For example, detachable supports 120 that provide rise of between approximately ½ inch and 3 inches may be employed.

Figure 7:
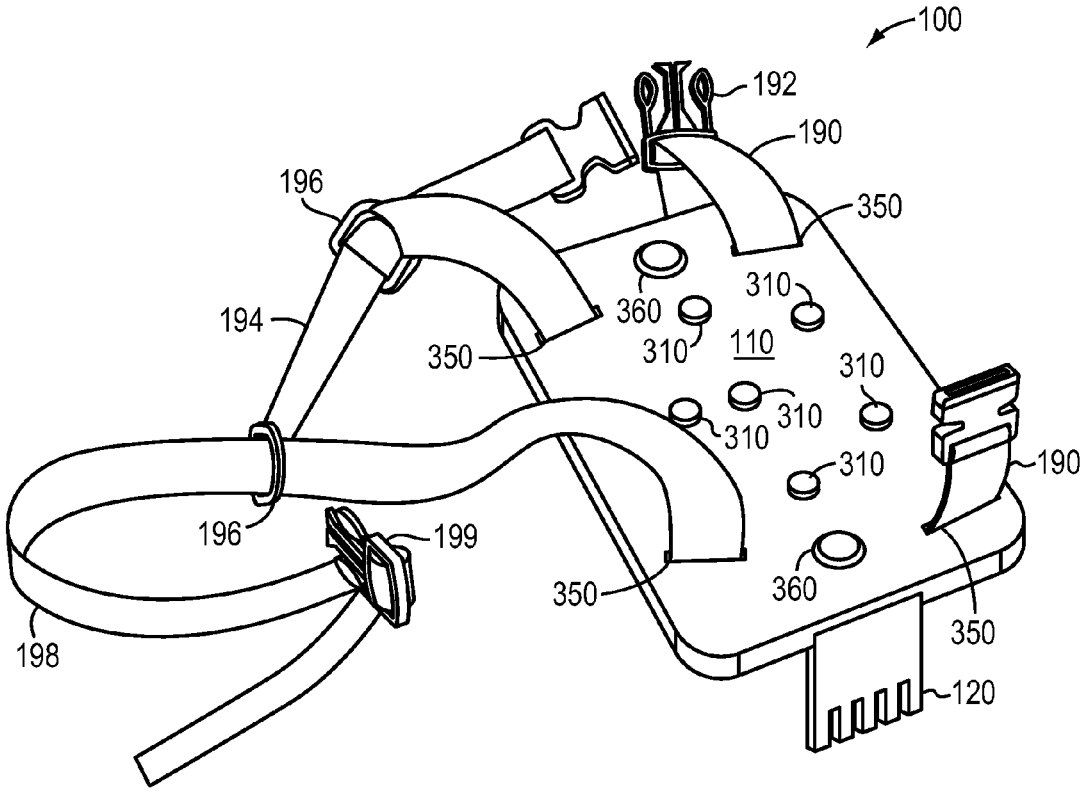
FIG. 7 is a second perspective view of the hiking boot attachment secured to a hiking boot showing additional detail of the strap system.

The platform 110 and the detachable supports 120 are preferably secured to the hiking boot 150 by a strap system. While a variety of types of strap systems 140 may be employed, in one configuration, the strap system 140 includes three primary straps. In reference to FIGS. 1 and 7, a first instep strap 190 is threaded through first and second slots 350, located towards the front of the platform 110, and secured over the lower instep of the boot with a quick-connect clip 192 or other hardware. A second instep strap 194 is threaded through third and forth slots 350, located towards the rear of the platform 110. A portion of the second instep strap 194 may extend through loops 196 to form an ankle strap 198 that secures about the ankle of the hiking boot 150, with a second a quick-connect clip 199 or other hardware. The straps of the strap system 140 may be constructed from various types of strong, flexible material. For example, the straps may be constructed from nylon webbing.

While the above description discusses an example embodiment of the present disclosure, it should be apparent that a number of modifications and/or additions may be made without departing from the disclosure's intended spirit and scope.

For example, while it is suggested above that the hiking boot attachment 100 is to be used with a hiking boot 150, it should be apparent that the attachment 100 may alternatively be employed with a variety of other types of outdoor footwear, for example, sneakers, sandals (e.g., hiking sandals), shoes, etc.

Further, while it is suggested in the Figures that the horizontally-extending leg 620 of each of the detachable supports 120 extends approximately to the edge of the platform 110, and is substantially flush therewith, in some configurations, each horizontally-extending leg 620 may extend beyond the edge of the platform 110. This further extension may advantageously provide grater separation of the downwardly-extending legs 630, to provide additional stability. In such a configuration, the separation of the downwardly-extending legs 630 may be made adjustable. For example, a plurality of spaced holes may be formed in each horizontally-extending leg 620, and a user may select the one of these holes that provides the desired amount of separation for use with the screw 440.

Further, while it is suggested above that the hiking boot attachment 100 includes separate first and second detachable supports 120, such supports 120 may be combined into a single integrated structure. For example, a one-piece detachable support may include a single horizontally-extending leg spanning the width 320 of the platform 110, with first and second downwardly-extending legs extending from each end thereof. Alternatively, a one-piece detachable support may be differently arranged.

Further, while the hiking boot attachment 100 is discussed in isolation above, the hiking boot attachment may be used in conjunction with a variety of other hiking apparatus to assist a hiker in the descent of slopes. For example, the hiking boot attachment 100 may be used by a hiker in conjunction with trekking poles (i.e. hiking poles) or a hiking stick. When used together, the taking poles or hiking stick may provide further stabilization for the hiker while descending a slope.

Accordingly, it should be understood that the above descriptions are meant to be taken only by way of example.

What is claimed is:

1. A hiking boot attachment configured to assist in the descent of slopes, comprising:

a platform having a bottom face and a top face;

a first downwardly-extending leg coupled to a first horizontally-extending leg that engages the bottom face of the platform to form a first support, the first downwardly-extending leg to extend downward and laterally outward from a center of the platform, such that an angle formed between the bottom face of the platform and the first downwardly-extending leg is greater than 90 degrees, the first downwardly extending leg having a first ground-contacting end remote from the platform;

a second downwardly-extending leg coupled to a second horizontally-extending leg that engages the bottom face of the platform to form a second support, the second downwardly-extending leg to extend downward and laterally outward from the center of the platform, such that an angle formed between the bottom face of the platform and the second downwardly-extending leg is greater than 90 degrees, the second downwardly extending leg having a second ground-contacting end remote from the platform; and a strap system that includes one or more straps positioned to, when tightened upon a hiking boot, hold the platform under a sole of the hiking boot, with the bottom face directed towards ground, and the top face directed towards the sole of the hiking boot, wherein a width between the first ground contacting end of the first downwardly extending leg and the second ground contacting end of the second downwardly extending leg is greater than a width of the platform.

2. The hiking boot attachment of claim 1, wherein the first support and the second support are detachable supports removably secured to the platform.

3. The hiking boot attachment of claim 2, wherein the detachable supports are each secured to the platform by one or more detachable fasteners.

4. The hiking boot attachment of claim 3, wherein each of the one or more detachable fasteners is selected from the group consisting of a screw, a bolt and a nut, a threaded stud and a nut, and a threaded stud and a threaded socket.

5. The hiking boot attachment of claim 2, wherein each of the detachable supports secured to the platform have a first height, and the hiking boot attachment is provided with one or more additional detachable supports that have a second height, the one or more additional detachable supports that have the second height configured to replace the detachable supports secured to the platform.

6. The hiking boot attachment of claim 1, wherein the first ground-contacting end of the first downwardly-extending leg and the second ground-contacting end of the second downwardly-extending leg each include one or more grip-promoting features.

7. The hiking boot attachment of claim 2, wherein each of one or more detachable supports is constructed from a metal.

8. The hiking boot attachment of claim 1, wherein first and second side portions of the platform include slots configured to receive a first instep strap and a second strap of the strap system.

9. The hiking boot attachment of claim 1, wherein the platform is constructed from an Ultra-High Molecular Weight (UHMW) polyethylene.

10. The hiking boot attachment of claim 1, further comprising:

a drift stop that extends upward from the top face of the platform and is configured to contact a side of the sole of the hiking hoot to prevent movement thereof with respect to the platform.

11. A hiking boot attachment configured to assist in the descent of slopes, comprising:

a substantially-rectangular platform having a bottom face and a top face;

a first support secured to the platform, the first support having a first horizontally-extending leg that engages the bottom face of the platform and a first downwardly-extending leg that extends downward and laterally outward from a center of the platform, such that an angle formed between the bottom face of the platform and the first downwardly-extending leg is greater than 90 degrees, the first downwardly extending leg having a first ground-contacting end remote from the platform;

a second support secured to the platform, the second support having a second horizontally-extending leg that engages the bottom face of the platform and a second downwardly-extending leg that extends downward and laterally outward from the center of the platform, such that an angle formed between the bottom face of the platform and the second downwardly-extending leg is greater than 90 degrees, the second downwardly extending leg having a second ground-contacting end remote from the platform; and a strap system that includes a first instep strap and a second strap, the first instep strap and the second strap positioned to, when tightened upon a hiking boot, hold the platform centered under a mid-portion of a sole of the hiking boot, in a region under a ball of a hiker's foot, with the bottom face directed towards ground, and the top face directed towards the sole of the hiking boot, wherein a width between the first ground contacting end of the first downwardly extending leg of the first support and the second ground contacting end of the second downwardly extending leg of the second support is greater than a width of the platform.

12. The hiking boot attachment of claim 11, wherein the first support and the second support are each detachable supports removably secured to the platform.

13. The hiking boot attachment of claim 11, wherein both the first ground-contacting end of the first support and the second ground-contacting end of the second support are substantially flat to engage, but resist penetrating, the ground.

* * * * *

UNITED STATES PATENT AND TRADEMARK OFFICE

CERTIFICATE OF CORRECTION

PATENT NO. : 8,371,045 B2
APPLICATION NO. : 12/578460
DATED : February 12, 2013
INVENTOR(S) : Georges-André Tambay It is certified that error appears in the above-identified patent and that said Letters Patent is hereby corrected as shown below:

In the Claims:

Col. 8, line 21 should read: --the hiking boot to prevent movement thereof with--.

Signed and Sealed this
Twenty-eighth Day of May, 2013

Teresa Stanek Rea
*Acting Director of the United States Patent and Trademark Office*